United States Patent [19]

Kraft et al.

[11] 4,321,819

[45] Mar. 30, 1982

[54] PRESS CONSTRUCTION

[75] Inventors: Derald H. Kraft; William S. Wagner, both of Canton, Ohio

[73] Assignee: Dyneer Corporation, Canton, Ohio

[21] Appl. No.: 190,093

[22] Filed: Jul. 23, 1980

[51] Int. Cl.[3] ..... B21J 13/04

[52] U.S. Cl. ..... 72/456; 72/389; 72/453.14; 100/258 A

[58] Field of Search ..... 72/456, 389, 386, 319, 72/453.14; 100/214, 258 A, 46

[56] References Cited

U.S. PATENT DOCUMENTS

| | | | |
|---|---|---|---|
| 2,221 | 8/1841 | Houpt | 100/258 A |
| 2,302,132 | 11/1942 | MacMillin | 100/258 A |
| 2,589,756 | 3/1952 | Waters | 100/93 P |
| 2,890,649 | 6/1959 | Hodges | 100/231 |
| 3,198,108 | 8/1965 | Ingold | 100/257 |
| 3,550,425 | 12/1970 | Cailloux | 72/453.14 |
| 3,568,498 | 3/1971 | Pearson | 72/456 |

FOREIGN PATENT DOCUMENTS

| | | | |
|---|---|---|---|
| 2344432 | 4/1974 | Fed. Rep. of Germany | 72/456 |
| 1236985 | 6/1960 | France | 72/456 |
| 55-77929 | 6/1980 | Japan | 72/389 |

*Primary Examiner*—Gene P. Crosby
*Attorney, Agent, or Firm*—Frease & Bishop

[57] ABSTRACT

A gap-framed type press has a horizontal bed which holds a lower die that cooperates with an upper die mounted on a vertically reciprocally movable ram to perform a metal-working operation therebetween. Hydraulic cylinders are operatively engaged with the ram for moving the die members into and out of engagement. The ram is movably mounted on a pair of spaced vertical side plates which are bolted to the press bed. The bed is supported on a pair of side frame members by a pair of spaced spherical bearings. The side frame members extend parallel with and closely adjacent to the ram-carrying side plates and are connected to the side plates by a sliding connection. The elastic bending and deformation forces which are applied to the press frame during each operation are transmitted between the side frame members and side plates through their sliding connection and between the bed and side frame members by the spherical bearings. The side frame members, side plates, ram and press bed will rotate about a horizontal axis extending between the center points of the spaced spherical bearings to maintain the upper and lower dies in parallel.

19 Claims, 15 Drawing Figures

FIG. 1
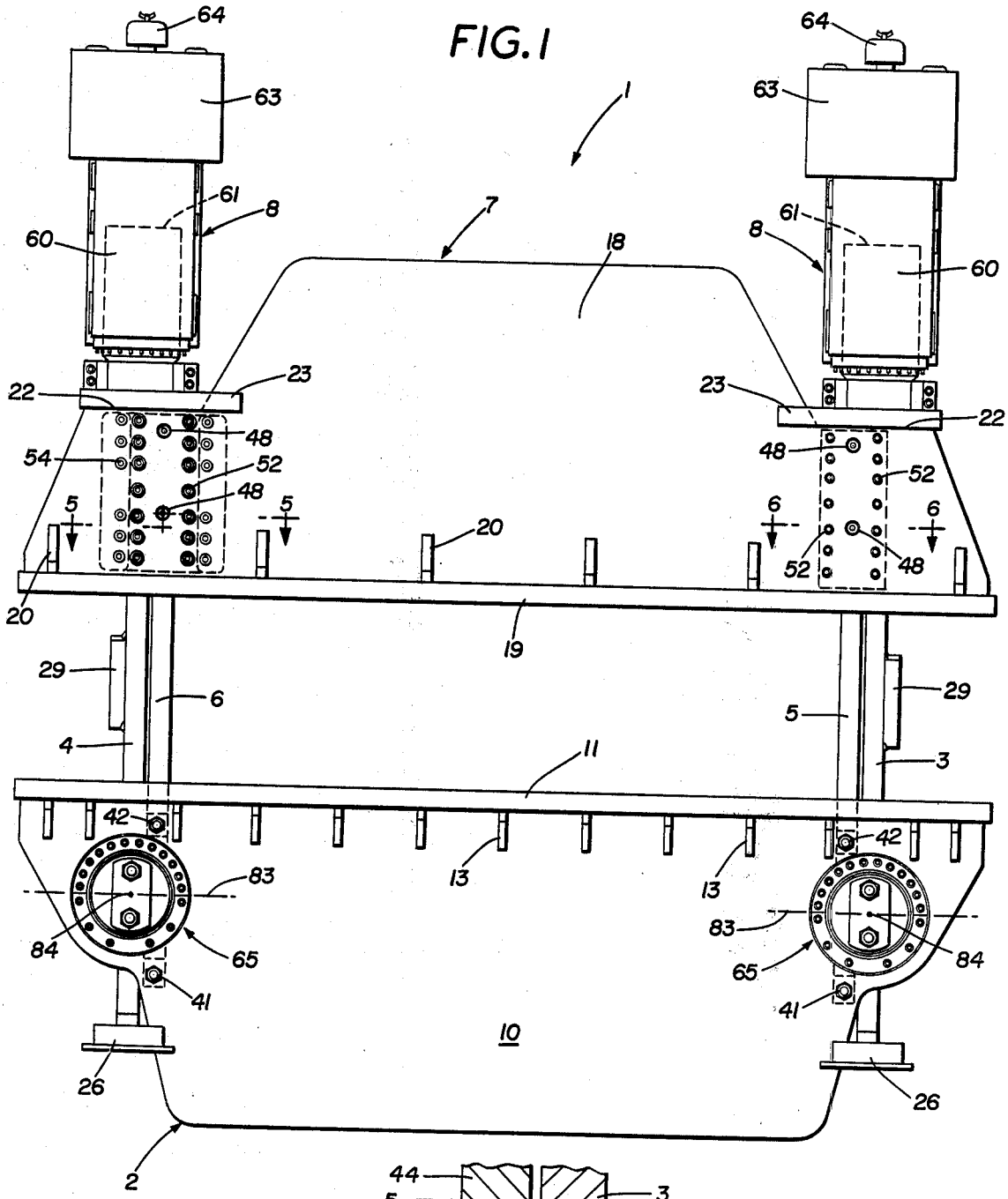
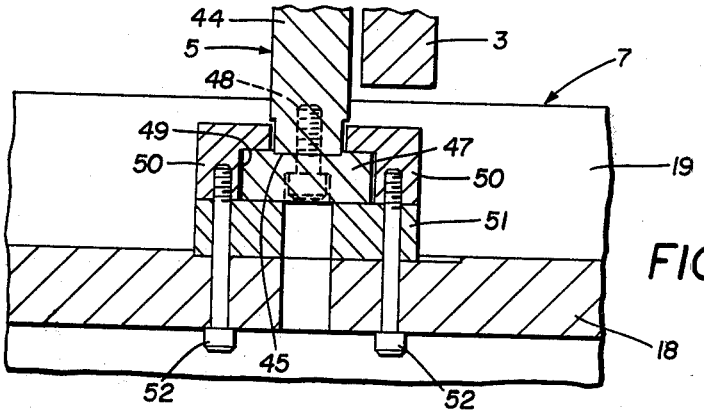
FIG. 6

FIG. 4
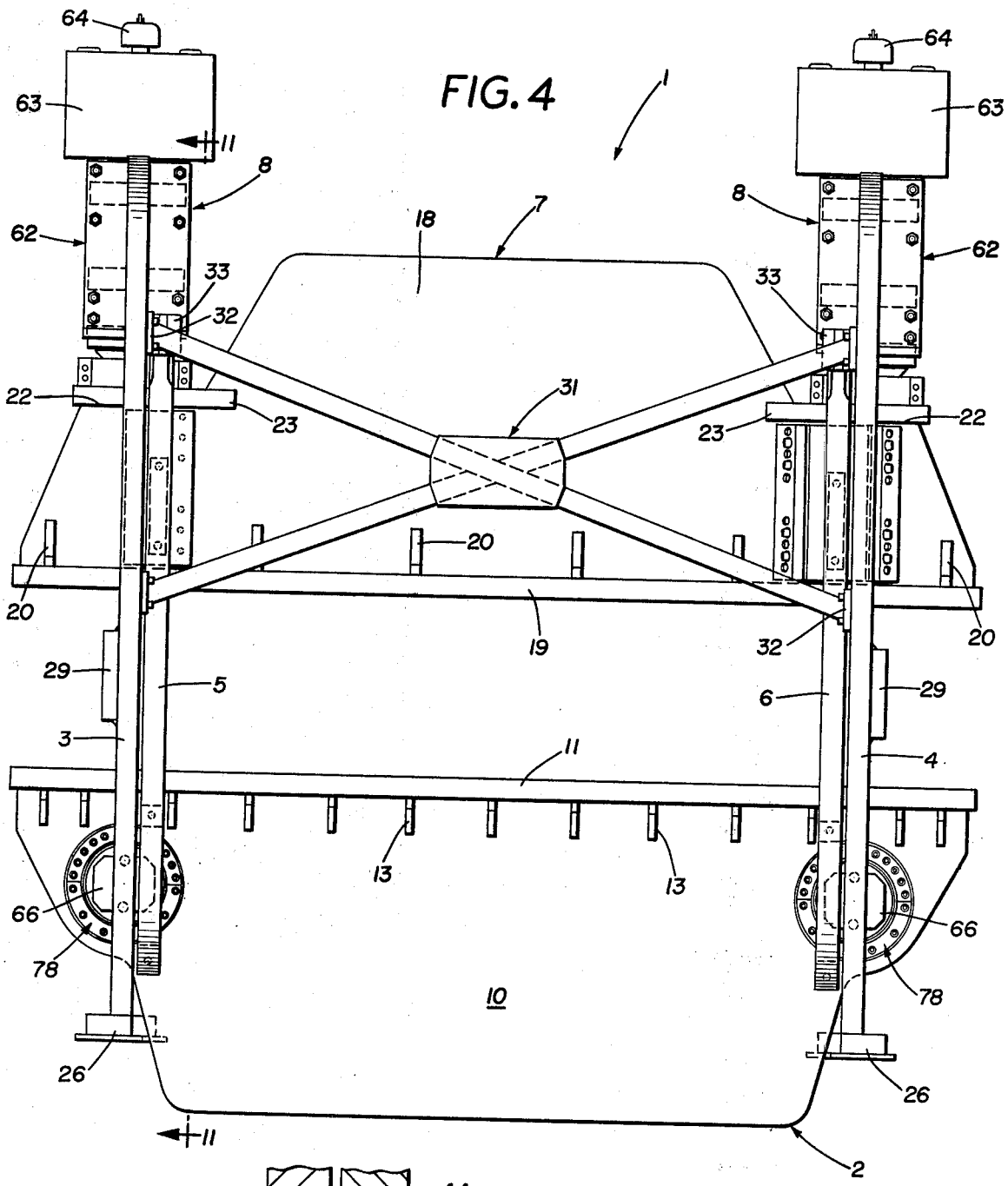
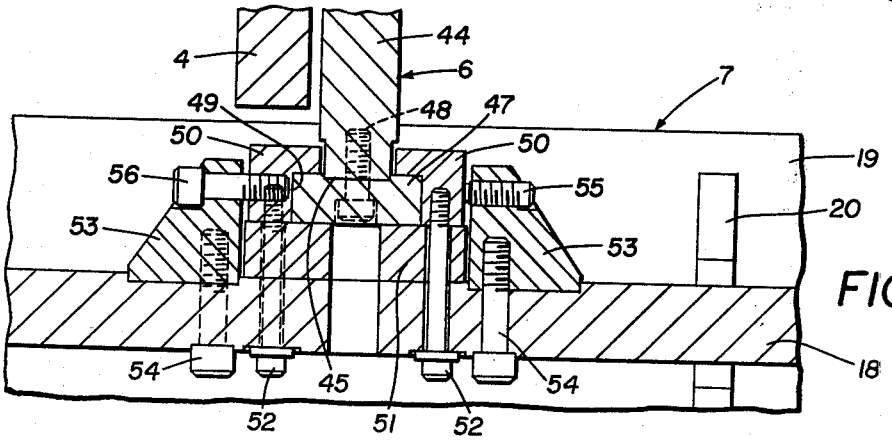
FIG. 5

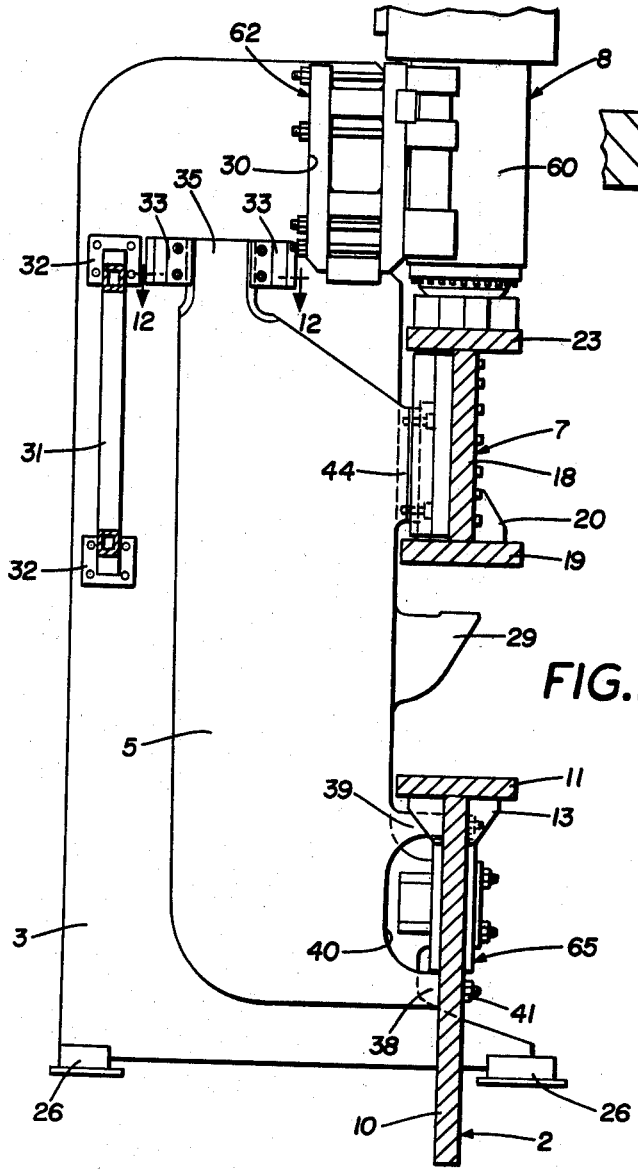
FIG.11
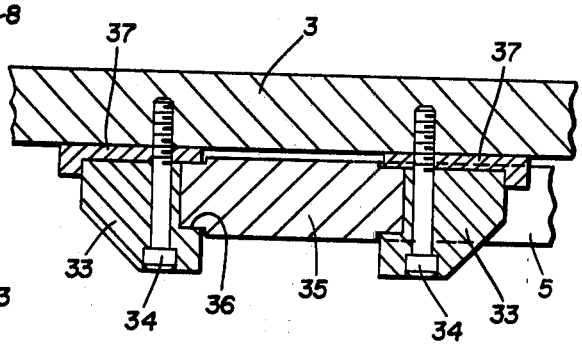
FIG.12
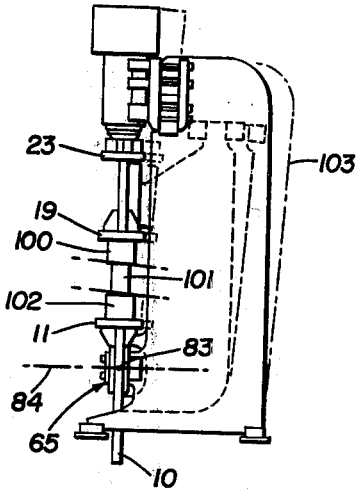
FIG.13
FIG.14
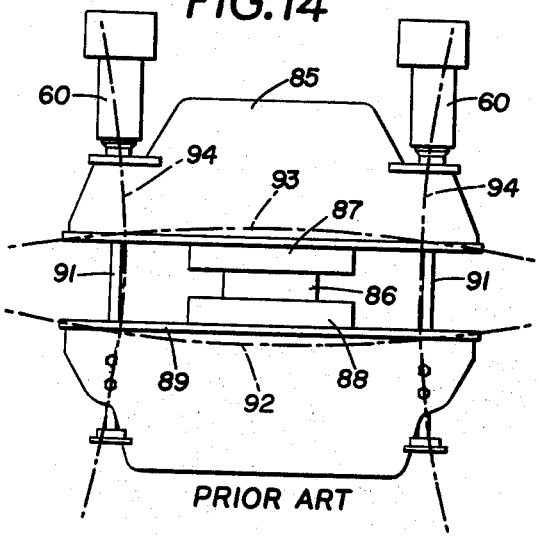
PRIOR ART
FIG.15
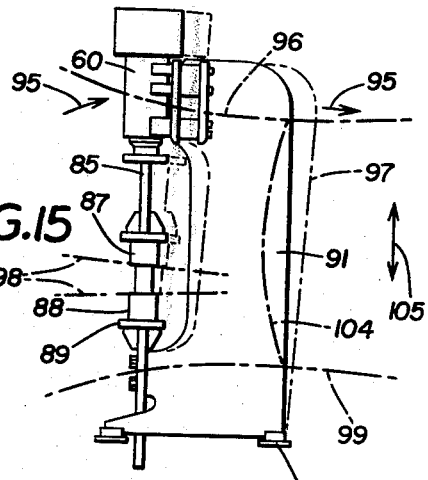
PRIOR ART

PRESS CONSTRUCTION

BACKGROUND OF THE INVENTION

1. Field of the Invention

The invention relates to presses and, in particular, to gap-framed type presses. More particularly, the invention relates to a gap-framed press in which the lower die holding bed and vertical side frame members are interconnected by spherical bearings. The elastic bending and deformation exerted on the press frame during a press operation are transmitted through the bearings to the various frame and die holding components so that the top and bottom dies move in unison in the same direction to maintain the dies in parallel and reduce die wear and breakage.

2. Description of the Prior Art

There are numerous types and styles of presses for performing metal-working procedures such as bending, shaping, punching or shearing on a workpiece. In many presses, a pair of upper and lower die members are moved into cooperating relationship with each other by power-driven means such as hydraulic or mechanically actuated devices or the like. The lower die usually is mounted on a stationary bed and the upper die is mounted on a vertically movable ram or slide. Large forces are exerted on the press frame and components thereof when the dies are brought into engagement with each other during the metal-working operation.

There are various types of presses classified according to frame design. Two general types of presses are referred to as being gap-framed and straight-sided. A straight-sided press has a slide or ram which holds a top die. The ram travels downwardly between two straight sides of a housing usually supported by four corner posts to perform work on the workpiece which is supported on a bottom die mounted on the stationary press bed. A gap-framed press has side frames which form the general shape of the letter "C". This shape permits feeding of wide or large sheets from both sides and from the front of the press into the work area between the dies. Also, these gap-framed presses enable a workman to be closer to the workpiece than possible with the straight-sided press frame constructions. Furthermore, the gap-framed presses are smaller and less expensive than a comparable straight-sided press.

Although the gap-framed type presses have many advantages over the straight-sided presses, they have the disadvantage of misalignment occurring between the upper and lower dies due to the unbalanced forces which are exerted on the C-shaped press frame side members during a press operation. During a press operation, the forces exerted on the C-shaped frame will cause the upper portion of the frame sides to rotate or tilt in one direction causing the upper die to rotate or tilt in the same direction. This results in misalignment with the lower die which may not move as much as the upper die or may move in an opposite direction. Even though such misalignment is relatively slight (thousandths of an inch), it results in uneven die wear and breakage, especially when the dies include components such as pins on one die which move into and out of openings formed in the opposite die. This misalignment problem is further magnified in high-speed press operations wherein large numbers of parts are produced in a relatively short period of time. The vertical side frame members of a gap-framed press also will tend to move inwardly toward each other and then outwardly due to the repeated flexing up and down of the press bed and top ram. Again, even though this flexing is in the thousandths of an inch range, it results in press fatigue and die misalignment.

One known press construction attempts to eliminate the problems caused by the flexing of the die-holding lower bed and resulting inward stresses which are placed on the side frame members by transmitting the bed loads to the frame through large-diameter, circular bearing blocks. This construction consists of a pair of spaced key-shaped bearing members which are rigidly mounted on the front ends of the side frames. These bearing members project into complementary-shaped keyway openings formed in the vertical front plate of the bed. This mounting arrangement enables the bed during flexing to rotate on the circular portion of the key-shaped bearing members. However, this arrangement does not enable the bed plate to rotate on the key-shaped bearings about a common axis which extends horizontally between the center points of the bearings to compensate for the twisting and skewing forces exerted on the top die and ram to prevent misalignment of the mating dies.

Accordingly, the need has existed for a gap-framed or C-type press which eliminates or substantially reduces misalignment between the upper and lower dies which heretofore occurred due to the unbalanced forces which are exerted on the C-shaped press frame during a press operation. There is no known gap-framed or C-type press construction of which we are aware which eliminates this problem by the mounting of the press bed and side frames on a pair of spherical bearing members.

SUMMARY OF THE INVENTION

Objectives of the invention include providing an improved press construction of the gap-framed or C-type configuration which maintains parallel alignment between the upper and lower dies during press operations by connecting the bed and certain side frame members together by a pair of spherical bearings so that the dies and their supporting members will rotate in the same direction about a common axis which extends between the spherical bearings; providing such a press in which the vertical flexing or bowing of the horizontal press bed which occurs during press operations will act upon the supporting bearings, thereby preventing the flexing forces from being applied to the vertical supporting side frame members, which heretofore caused the side frame members to repeatedly move inwardly and outwardly, causing fatigue and improper press operation; providing such a press in which the life of the dies is increased and die breakage reduced due to the dies being maintained in parallel during press operations, even in high-speed press applications and even when the dies include components which move into and out of openings formed in one or both of the dies; providing such a press in which various types of power drive units such as hydraulic or mechanically actuated cylinders can be used to reciprocally move the vertical slide or ram in its usual manner, thereby eliminating the need for special drive systems and associated controls therefor; providing such a press in which each of the side frame members is formed by a pair of parallel, closely spaced frames or plates, one of which is attached at its bottom to the spherical bearing and the other being rigidly attached to the front plate of the press bed, with the upper ends of these members being operatively connected through an alignment sliding guide plate connection; providing such a press in which the power drive cylinders and pistons are mounted on the upper portion of the side frame members which are connected to the press bed by the spherical bearing, and in which the vertical slide or press ram which is moved by these cylinders is mounted on the side frame members or plates which are rigidly attached to the front plate of the press bed; and providing such an improved press construction which eliminates difficulties encountered with prior presses, solves problems and obtains new results in the art.

These objectives and advantages are obtained by the improved press construction of the invention, the general nature of which may be stated as including a bed for mounting first die means thereon; a pair of spaced side frame means extending from the bed; slide means movably mounted on the side frame means for reciprocal movement toward and away from the bed, said slide means being adapted to receivably mount second die means thereon for cooperative engagement with the first die means; drive means engaged with the slide means for reciprocally moving the slide means on the side frame means to perform work on a workpiece located between the first and second die means; and spherical bearing means operatively connecting the side frame means with the bed, enabling the side frame means and bed to rotate about an axis of the spherical bearing means which extends parallel to the bed and perpendicularly to the side frame means to maintain the die means in parallelism when the bed and side frame means are subjected to elastic bending and deformation forces during a press operation.

BRIEF DESCRIPTION OF THE DRAWINGS

A preferred embodiment of the invention—illustrative of the best mode in which applicants have contemplated applying the principles—is set forth in the following description and shown in the drawings and is particularly and distinctly pointed out and set forth in the appended claims.

FIG. 1 is a front elevational view of the improved press construction;

FIG. 4 is a rear elevational view of the press construction shown in FIGS. 1–3;

FIG. 5 is an enlarged fragmentary sectional view taken on line 5—5, FIG. 1, showing the left-hand end of the upper ram slide mounting arrangement;

FIG. 6 is an enlarged fragmentary sectional view taken on line 6—6, FIG. 1, showing the right-hand end of the upper ram slide mounting arrangement;

FIG. 8;

FIG. 11 is a vertical sectional view taken on line 11—11, FIG. 4;

FIG. 12 is an enlarged fragmentary sectional view taken on line 12—12, FIG. 11, showing the sliding connection between one of the side frame alignment plates and side frame member;

FIG. 13 is a diagrammatic side elevation showing the improved press maintaining the upper and lower dies in parallel during a press operation;

FIG. 14 is diagrammatic front elevation showing the flexing and bending which occurs in a usual prior art gap-framed type press during a press operation; and FIG. 15 is a diagrammatic side view of the prior art press shown in FIG. 14 showing the misalignment which occurs between the dies of the press during a press operation.

Similar numerals refer to similar parts throughout the drawings.

DESCRIPTION OF THE PREFERRED EMBODIMENT

Figure 2:
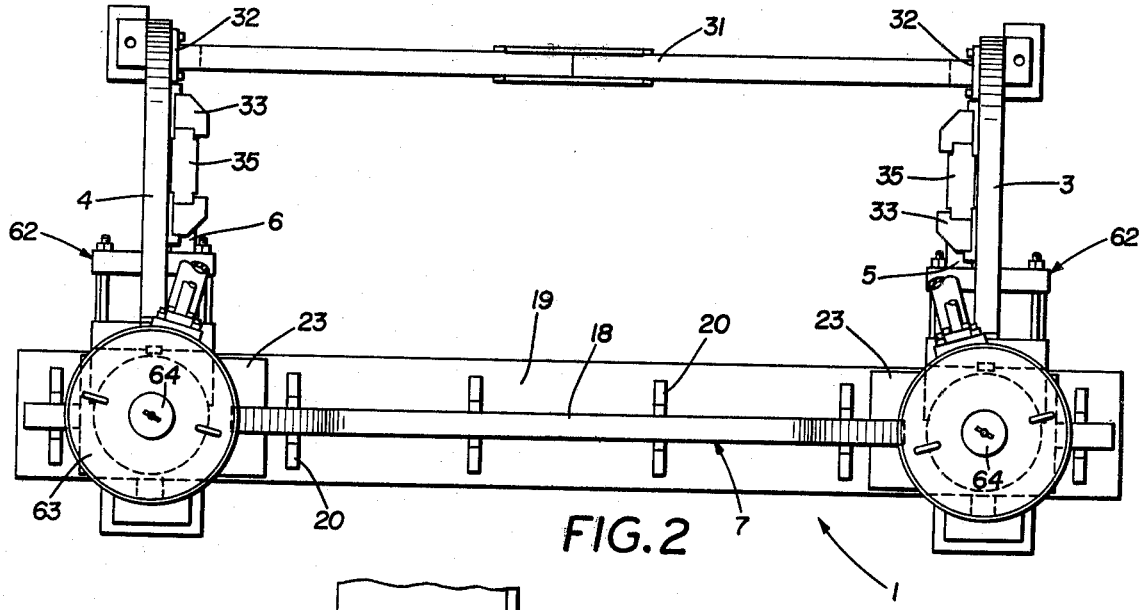
FIG. 2 is a top plan view of the improved press construction shown in FIG. 1.

The improved press construction is indicated generally at 1, and is shown in an assembled state in FIGS 1 through 4. Press 1 includes as main components a bed 2, a pair of vertically extending side frame members 3 and 4, a pair of vertically extending alignment plates 5 and 6, a vertically movable slide or ram 7, and a pair of power drive units 8.

Figure 7:
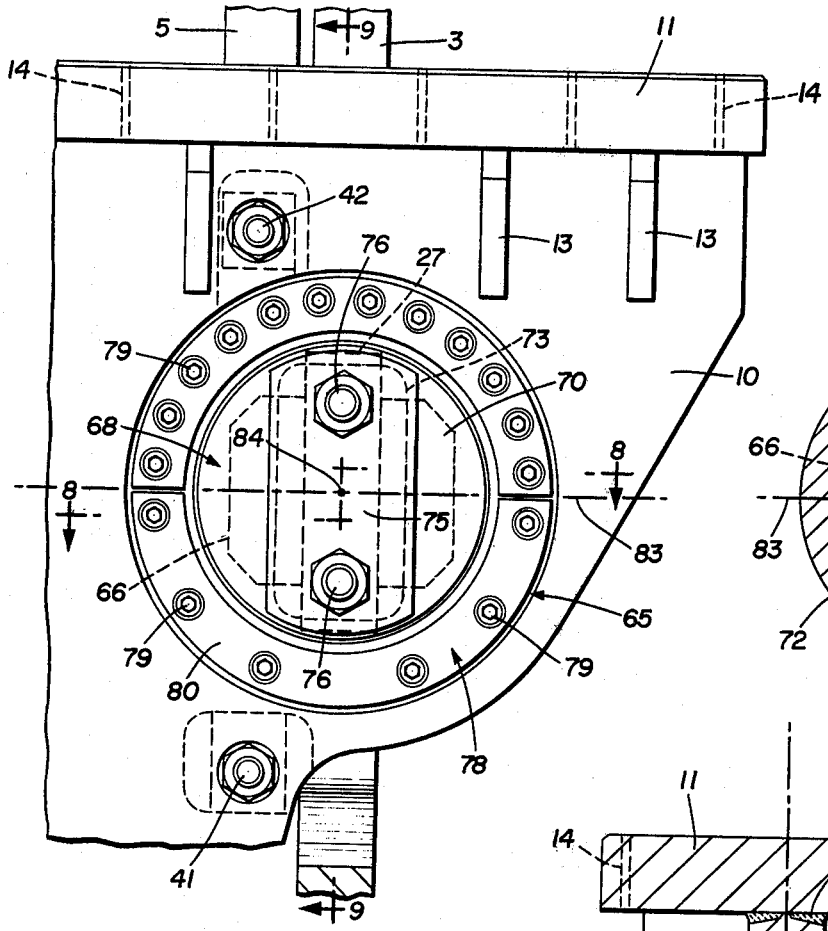
FIG. 7 is an enlarged fragmentary view of the right-hand spherical bearing mounting arrangement of the improved press, as shown in FIG. 1.

Bed 2 includes a vertically extending front plate 10 and a horizontal die-supporting plate 11. Plate 11 (FIGS. 7 and 9) is attached to the top of vertical front plate 10 by welds 12 and includes a plurality of spaced reinforcing flanges 13 which extend between the bottom of horizontal plate 11 and front plate 10. A bottom die (not shown) is adapted to be supported on the top surface of horizontal plate 11 and is secured thereon by mounting bolts which extend through a selective number of vertically extending holes 14 formed in plate 11. A pair of bearing-receiving circular openings 16 are formed on opposite ends of front bed plate 10, the function of which is described in greater detail below.

Upper slide 7 includes a main, vertically extending slide plate 18 which includes a horizontally extending top die-mounting plate 19 attached to the bottom of vertical slide plate 18. A plurality of spaced reinforcing flanges 20 extend between and are welded to vertical slide plate 18 and horizontal plate 19 to securely mount die-receiving plate 19 on plate 18. A pair of inwardly extending horizontal ledges 22 are formed on slide plate 18, generally intermediate the top and bottom edges thereof. A horizontal plate 23 is mounted on each ledge 22 for connecting slide plate 18 to power drive units 8.

Figure 3:
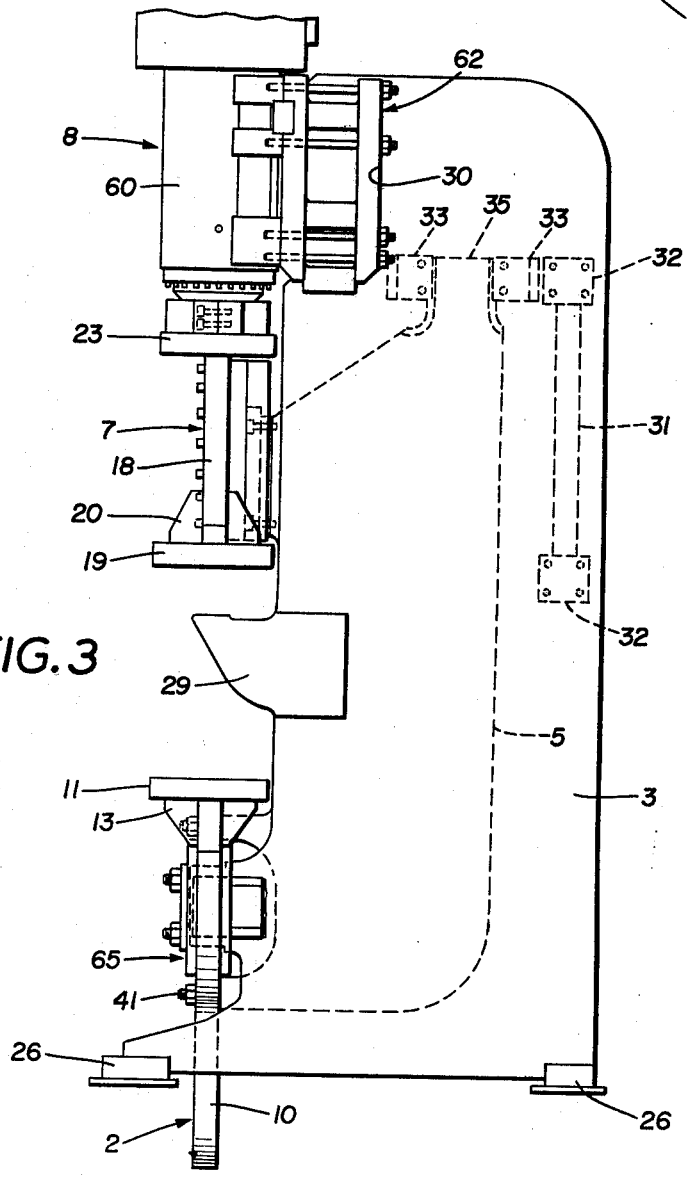
FIG. 3 is a fragmentary right-hand elevational view of the improved press construction shown in FIGS. 1 and 2.
Figure 8:
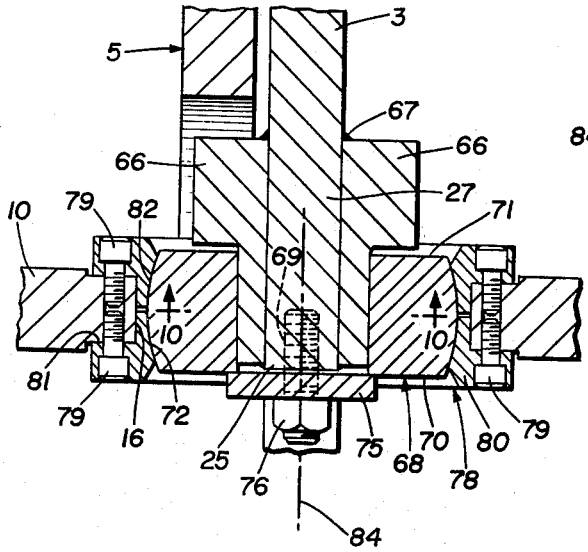
FIG. 8 is a fragmentary sectional view taken on line 8—8, FIG. 7.

Side frame members 3 and 4 are vertically extending, generally flat metal plates having a somewhat elongated rectangular configuration (FIG. 3). Press 1 is supported on the floor of a building by mounting pads 26 which are located at the front and rear corners of frame members 3 and 4. The lower portion of front bed plate 10 extends downwardly below pads 26 into a pit area (not shown). Frame members 3 and 4 (FIGS. 8 and 9) each include a forwardly extending bearing mounting portion 27 which projects through circular opening 16 of front bed plate 10. Mounting portions 27 terminate in vertically extending front edges 25.

A pair of slide stops 29 are welded on side frames 3 and 4, and project outwardly past the front edges thereof (FIGS. 1 and 3) to limit the downward stroke of vertical slide 7. The top front edge portions of side frames 3 and 4 are cut away at 30 (FIGS. 3 and 11) for mounting of power drive units 8 thereon. An X-brace assembly 31 (FIGS. 2, 3 and 4) extends between side frames 3 and 4 and is connected thereto by brackets 32 to reinforce and stabilize side frames 3 and 4 in a conventional manner.

In accordance with one of the features of the invention, a pair of alignment plate guides 33 (FIGS. 11 and 12) are mounted in a spaced relationship on an upper portion of each side frame 3 and 4 by a plurality of bolts 34 for operatively slidably connecting frames 3 and 4 with their respective closely adjacent alignment plates 5 and 6. The upper end of each alignment plate 5 and 6 is formed with an upwardly projecting portion 35 which is received within a slide channel 36 formed by the inner faces of alignment plate guides 33 and shim plates 37. This connection between side frames 3 and 4 and alignment plates 5 and 6 enables the various bending forces and stresses placed on these frame members to be transmitted therebetween in a manner described more fully below.

Figure 9:
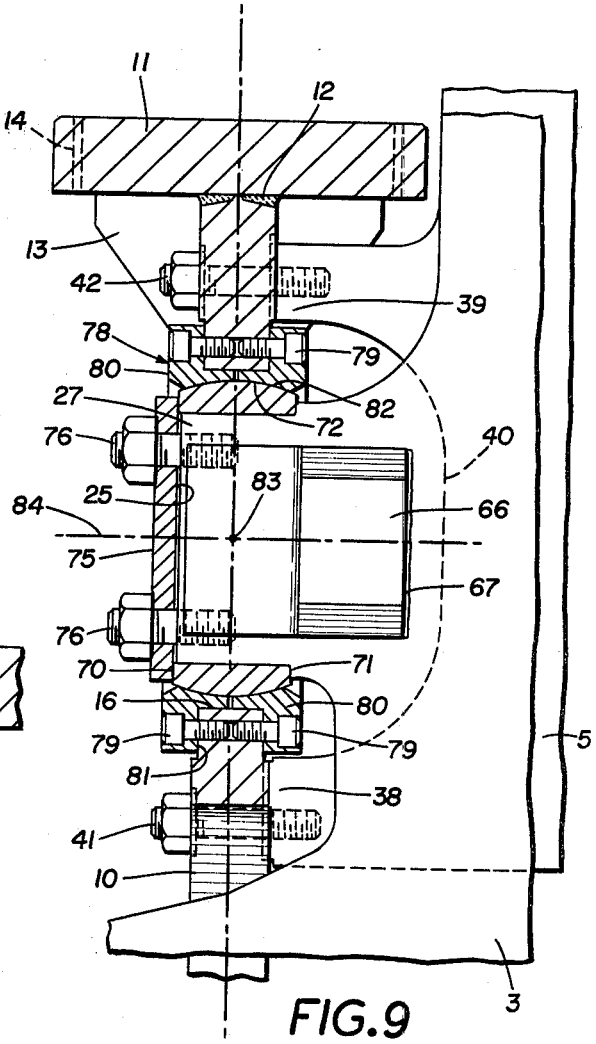
FIG. 9 is a fragmentary sectional view taken on line 9—9, FIG. 7.

Alignment plates 5 and 6 are similar, and the particular configuration thereof is best illustrated in FIG. 11. Alignment plates 5 and 6 each have a generally elongated configuration and are formed of flat planar metal sheets. Plates 5 and 6 extend vertically upwardly from bed 2 inside of and closely adjacent to their respective side frames 3 and 4. The lower portion of the front edge of each alignment plate 5 and 6 is formed with a pair of forwardly extending portions 38 and 39 which form a concave, nearly semicircular recess 40 therebetween. Portions 38 and 39 provide the lower attachment means for mounting alignment plates 5 and 6 on front plate 10 of bed 2. Referring to FIG. 9, bed plate 10 is attached to projecting portions 38 and 39 by bolts 41 and 42, respectively.

The upper portion of the front edge of each alignment plate 5 and 6 is formed with an outwardly projecting portion 44. Projections 44 terminate in vertically extending edges 45 which provide the attachment areas for mounting slide 7 on alignment plates 5 and 6 (FIG. 5 and 6). FIG. 6 shows the right-hand slide connection between alignment plate 5 and slide 7 viewed looking toward the front of the press in FIG. 1, with FIG. 5 showing the left-hand slide connection between alignment plate 6 and slide 7.

Referring particularly to FIG. 6, a gib 47 is attached to front edge 45 of alignment plate 5 by a pair of bolts 48. Gib 47 is located within a slide channel 49 formed by a pair of gib ways 50 and a gib wear plate 51. Gib ways 50 and wear plate 51 are mounted on the inner surface of vertical plate 18 of slide 7 are mounted on the inner surface of vertical plate 18 of slide 7 by a plurality of bolts 52. The left-hand slide connection, shown in FIG. 5, is similar to that of FIG. 6 in that a gib 47 is mounted by bolts 48 on front edge 45 of alignment plate 6 and is located within slide channel 49 formed by a pair of spaced gib ways 50 and wear plate 51 which are mounted on slide plate 18 by bolts 52. The left-hand slide connection further includes a pair of gib back-up bars 53 which are mounted on slide plate 18 by bolts 54. Bars 53 are operatively engaged with gib ways 50 by bolts 55 and 56. Bolts 55 and 56 permit adjustment of gib ways 50 to provide adjustment for the horizontal spacing between slide channels 49 to enable an accurate smooth sliding engagement to be achieved between side plates 5 and 6 and slide 7.

Power drive units 8 are similar to each other, with each unit including a hydraulically actuated cylinder 60 having a power-driven internal piston 61. Each cylinder 60 is mounted by a bracket assembly 62 on upper cutaway portions 30 of side frames 3 and 4 (FIGS. 3, 4 and 11). Pistons 61 act upon plates 23 for imparting reciprocal sliding movement to slide 7. An oil fill tank 63 preferably is mounted on the top of each hydraulic cylinder 60 and includes an air filter 64. Hydraulic cylinders 60 are interconnected by various control lines, limit switches and the like (not shown) which are connected to the appropriate control equipment for regulating the vertical sliding movement of slide 7. The control mechanism forms no particular part of the invention, and thus is not described in detail. Furthermore, power drive units 8 may be pneumatic, hydraulic, electrical, or the like without affecting the concept of the invention.

Figure 10:
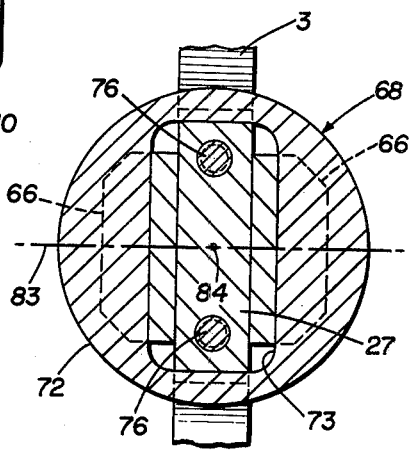
FIG. 10 is a fragmentary sectional view taken on line 10—10.

In accordance with one of the main features of the invention, a pair of spherical bearing assemblies, each of which is indicated generally at 65, operatively connects bed 2 with side frames 3 and 4. Assemblies 65 are similar to each other and, therefore, only one assembly is shown and described in detail in FIGS. 7–10. Each bearing assembly 65 includes a pair of stepped frame mounting blocks 66 which are welded at 67 on opposite sides of bearing mounting portions 27 of side frames 3 and 4. An inner race, indicated generally at 68 (FIG. 10), has an annular, disc-shaped configuration with flat front and rear surfaces 70 and 71 and an annular convex peripheral surface 72. A generally rectangular-shaped opening 73 is formed through the central portion of inner race 68. Inner race 68 is mounted on the stepped front end of frame mounting blocks 66 and is secured thereon by a generally rectangular-shaped retaining cover plate 75. Plate 75 is abutted against front surface 70 of inner race 68 in a clamping relationship therewith by a pair of bolts 76, engaged within complementary-shaped holes 69 formed in edge 25 of mounting portion 27.

An outer spherical bearing race, indicated generally at 78 (FIGS. 8 and 9), is mounted within each opening 16 of bed plate 10 by a plurality of circumferentially spaced bolts 79. Outer race 78 is formed by a pair of annular-shaped half-race sections 80 which, when joined together by bolts 79, form an annular outer groove 81 for receiving the circular edge of bed plate opening 16. The inner surfaces of half-race sections 80 form a concave recess 82 having a radius of curvature complementary to the radius of curvature of convex peripheral surface 72 of inner race 68. Spherical bearing assemblies 65 enable horizontal plate 11 of bed 2 to rotate on inner races 68 about a common horizontal axis of the bearing assemblies indicated at 83 (FIG. 1). Axis 83 extends parallel with bed plate 11 between the center points of bearing assemblies 65. Plate 11 also will flex and rotate about the horizontal axes of bearing assemblies 65, indicated at 84 (FIGS. 1 and 13), which extend perpendicularly to bed plate 11 and parallel with the planes of side frames 3-4 and alignment plates 5-6.

Before describing in detail the features and advantages of improved press 1, reference to FIGS. 14 and 15 showing prior art gap-framed presses and the problems encountered therewith will make clearer the features and advantages of press 1. FIG. 14 is a front view of a prior art gap-framed type press showing in somewhat exaggerated condition the various flexing, elastic bending and deformations which take place during a press operation.

The force exerted by the ram or upper slide 85 on a workpiece 86 located between upper and lower dies 87 and 88 is transmitted to press bed 89, causing the bed and ram to bow downwardly and upwardly, as is indicated by dot-dash lines 92 and 93. This flexing movement of bed 89 and slide 85 places a corresponding, inwardly directed force or strain on side frames 91 due to the rigid connections therebetween, resulting in an inward bowing or flexing movement of side frames 91, shown in exaggerated condition by dot-dash lines 94. Although the various bowing and inward flexing movement and forces exerted on bed 89 and side frames 91 represented by dot-dash lines 92, 93 and 94, are exaggerated for illustration purposes, these stresses and forces will affect the operation of the press and life of the dies.

Another problem that occurs with C-frame or gap-framed type presses is shown diagrammatically in FIG. 15. The downward force exerted by slide 85 on bed 89 causes an opposite reaction on the upper portions of side frame members 91. Due to the general C-shaped configuration of frame members 91, the top portions of the "C" frame attempt to rotate in the clockwise direction of arrow 95, causing a crown deflection, as shown by dot-dash line 96. Simultaneously, a bed deflection occurs, indicated by dot-dash line 99. Likewise, two other deflections will occur in the frame, namely a side frame member deflection indicated by dot-dash line 104 and a vertical elongation shown by arrow 105. These forces on the upper and lower portions of frame members 91 which support upper and lower dies 87 and 88 impart a twisting moment on the frame, indicated generally by dot-dash line 97, causing the mating components of upper and lower dies 87 and 88 to become misaligned with respect to each other. Bottom die 88 is not affected the same amount as is upper die 87. This misalignment is shown by the pair of dot-dash lines 98 in FIG. 15. It is this misalignment or skewing of the dies from the required parallel arrangement which results in die breakage and loss of die life, and it is this problem which is greatly alleviated by improved press construction 1, as described below.

In a normal press operation, hydraulically actuated pistons 61 move slide 7 downwardly toward bed 2 by engagement of pistons 61 with horizontal plates 23 mounted on slide plate ledges 22 (FIG. 1). When slide 7 reaches the bottom of its stroke, a top die 100 (FIG. 13) which is mounted on plate 19 engages a workpiece 101 supported on a bottom die 102 mounted on plate bed 11.

The vertical flexing or bowing of bed 11 in press 1, similar to that represented by dot-dash line 92 for the press shown in FIG. 14, is transmitted to spherical bearing assemblies 65, resulting in press bed 11 and front plate 10 rotating about the horizontal axes 84 of assemblies 65 which extend perpendicularly to front plate 10. This rotational movement of bed 2 on spherical bearing assemblies 65 eliminates the heretofore inward stresses that are placed on the side frame members, as occurs in prior press constructions, shown by dot-dash lines 94 in FIG. 14.

In accordance with one of the main features of the invention, the clockwise rotational forces which are exerted on the upper portions of alignment plates 5 and 6 during die closure are transmitted to side frame members 3 and 4 through the sliding connection formed by ends 35 of plates 5 and 6 and slide channels 36 formed on frame members 3 and 4 by guides 33. These rotational twisting forces then are transmitted through frame members 3 and 4 to bearing assemblies 65. The forces in the lower portions of alignment plates 5 and 6 also are transmitted to bearing assemblies 65 through bed plate 10 due to the rigid mounting of plates 5 and 6 on plate 10.

Thus, the elastic bending and deformation forces are transmitted by bearing assemblies 65 to the various press components, causing both top die mounting plate 19 and bottom die mounting plate 11 to move in unison about the common horizontal axis 83 which extends between the center points of the spherical bearings, as shown by dot-dash line 103 in FIG. 13. This uniform movement of both the top and bottom die supporting members in the same direction is achieved by the sliding connection between the upper portions of frame members 3 and 4 with alignment plates 5 and 6, the mounting of power drive cylinders 60 on side frame members 3 and 4 with the slide ram being mounted on alignment plates 5 and 6. Furthermore, the lower portions of alignment plates 5 and 6 are rigidly attached to bed plate 10, which in turn is mounted by bearing assembly 65 on side frame members 3 and 4.

This arrangement transmits the various elastic bending and deformation forces which are exerted on a press frame to the die members uniformly so that the dies rotate or move in the same direction, whereupon the upper and lower dies remain parallel even though they have twisted or rotated with respect to the horizontal. This die movement presents no problems since the die faces and mating components thereof still retain their aligned parallel positions. Improved press 1, instead of attempting to prevent such forces from acting on the dies, directs these forces by the arrangement and interconnection of the various press components discussed above to move the mating dies in unison, thereby maintaining them in parallel and achieving the desired results. Elimination of such movements and forces would be extremely difficult, if not impossible, due to the large forces generated on the frame components during a press operation and the inherent tendency and characteristic of the metal frame members to bend and deflect even in small amounts.

Accordingly, the improved press construction is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved press is constructed and used, the characteristics of the construction, and the advantageous, new and useful results obtained; the new and useful structures, devices, elements, arrangements, parts, and combinations, are set forth in the appended claims.

We claim:

1. A press construction of the gap-framed type including:

(a) a bed for mounting first die means thereon;

(b) a pair of spaced side frame means exending from the bed;

(c) slide means movably mounted on the side frame means for reciprocal movement toward and away from the bed, said slide means being adapted to receivably mount second die means thereon for cooperative engagement with the first die means;

(d) drive means engaged with the slide means for reciprocally moving the slide means on the side frame means to perform work on a workpiece located between the first and second die means; and (e) spherical bearing means operatively connecting the side frame means with the bed, enabling the side frame means and bed to rotate about an axis of the spherical bearing means which extends parallel to the bed and perpendicularly to the side frame means to maintain the first and second die means in parallelism when the bed and side frame means are subjected to elastic bending and deformation forces during a press operation.

2. The press construction defined in claim 1 in which each of the side frame means includes a side frame member and a closely adjacent alignment plate; in which the side frame members are connected to the bed by the spherical bearing means and the alignment plates are rigidly connected to the bed; in which the slide means is movably mounted on the alignment plates; and in which connection means operatively connect each of the alignment plates to a respective side frame member.

3. The press construction defined in claim 2 in which the drive means includes a pair of hydraulically actuated pistons, each of which is mounted on a respective one of the side frame members; in which the slide means includes a vertically movable ram; and in which said pistons are operatively engaged with the ram.

4. The press construction defined in claim 2 in which each of the alignment plates is connected to the bed at a pair of spaced locations, which locations lie on an imaginary line which bisects the adjacent bearing assembly.

5. The press construction defined in claim 2 in which gib means is mounted on each of the alignment plates and is located within a respective slide channel of a pair of spaced slide channels provided on the slide means to movably mount the slide means on said alignment plates.

6. The press construction defined in claim 5 in which one of the slide channels is adjustable to maintain alignment between the bed and slide means.

7. The press construction defined in claim 2 in which the connection means between the side frame members and alignment plates is a sliding connection providing limited movement between each of said frame members and its respective alignment plate.

8. The press construction defined in claim 7 in which the connection means includes a pair of spaced guide members mounted on each of the side frame members forming a slide channel therebetween; and in which projection means is provided on each of the alignment plates, with said projection means being slidably engaged in the slide channels of the side frame members.

9. The press construction defined in claim 1 in which the bearing means includes a pair of spherical bearings each having inner and outer races; in which a pair of spaced openings is formed in the bed adjacent the side frame means; in which the outer bearing races are mounted in said bed openings; and in which the inner bearing races are mounted on the frame means and are in operative engagement with the outer bearing races for operatively connecting the side frame means with the bed.

10. The press construction defined in claim 9 in which the bed includes a horizontally extending die mounting plate and a front plate extending vertically downwardly from said horizontal plate; and in which the bearing receiving openings are formed in horizontally spaced locations in the front plate of the bed.

11. The press construction defined in claim 10 in which the axis about which the side frame means and bed rotate to maintain the die means in parallel is a common axis extending horizontally between the center points of the pair of spherical bearings.

12. The press construction defined in claim 1 in which stop means is mounted on the side frame means and is engageable by the slide means to limit the movement of the slide means in a certain direction.

13. The press construction defined in claim 1 in which the bed extends horizontally between the spaced side frame means which extend vertically with respect to the bed; and in which the slide means includes a horizontal die mounting plate and a vertically extending slide plate connected to said die mounting plate.

14. The press construction defined in claim 1 in which brace means extends between the spaced side frame means to reinforce said frame means.

15. A press construction including:

(a) a pair of vertical side frame members;

(b) a bed having a horizontal lower die supporting plate and a vertical front plate connected to said horizontal plate and extending downwardly therefrom;

(c) bearing means operatively connected between the vertical front plate of the bed and each of the side frame members movably mounting the bed on the side frame members;

(d) a pair of alignment plates in juxtaposition with the side frame members, said alignment plates being attached to the front plate of the bed adjacent the bearing means;

(e) connector means operatively connecting each of the side frame members with a respective alignment plate providing limited movement therebetween.

(f) ram means movably mounted on the alignment plates for vertical reciprocal movement toward and away from the lower die supporting plate; and (g) power drive means mounted on the side frame members and operatively engageable with the ram means for reciprocally moving said ram means.

16. The press construction defined in claim 15 in which the bearing means are spherical bearings each having an inner and outer race; and in which the outer races are mounted on the vertical front plate of the bed and the inner races are mounted on the side frame members.

17. The press construction defined in claim 15 in which the connector means includes a pair of spaced guide means mounted on the side frame members forming a pair of slide channels; and in which means is mounted on each of the alignment plates and engageable with the slide channels providing a sliding engagement between the side frame members and alignment plates.

18. The press construction defined in claim 15 in which the ram means includes a vertical plate and a horizontal upper die mounting plate; in which the upper die mounting plate is parallel with the lower die mounting plate; and in which the alignment plates, bed and ram means move about a horizontal axis extending between the bearing means when the press is subject to deformation forces to maintain the upper and lower dies in parallel.

19. The press construction defined in claim 15 in which the power drive means is a hydraulically actuated member.

* * * * *